US005381965A

United States Patent [19]

Chabon et al.

[11] Patent Number: 5,381,965

[45] Date of Patent: Jan. 17, 1995

[54] FUEL INJECTOR

[75] Inventors: Michael W. Chabon, Northville; Bruce J. Harvey, Shelby Township, Macomb County; Thomas A. Lahnala, Farmington Hills; Hans J. Sailer, Lake Orion; Bac Ta, Farmington Hills; Christopher J. Treusch, St. Clair Shores, all of Mich.

[73] Assignees: Siemens Automotive L.P., Auburn Hills; Ford Motor Company, Dearborn, both of Mich.

[21] Appl. No.: 176,743

[22] Filed: Jan. 3, 1994

Related U.S. Application Data

[62] Division of Ser. No. 17,719, Feb. 16, 1993, abandoned.

[51] Int. Cl.[6] ..... F02M 51/00

[52] U.S. Cl. ..... 239/585.1; 239/585.3; 239/600; 251/129.16; 251/129.21

[58] Field of Search ..... 239/585.1–585.5, 239/600, 5; 251/129.15, 129.16, 129.21

[56] References Cited

U.S. PATENT DOCUMENTS

| | | | |
|---|---|---|---|
| 3,231,233 | 1/1966 | Herion | 251/129.21 |
| 3,795,383 | 3/1974 | Lombard et al. | 251/129.21 |
| 4,899,699 | 2/1990 | Huang et al. | 239/585.5 |
| 5,183,209 | 2/1993 | Ricco et al. | 251/129.15 |
| 5,244,180 | 9/1993 | Wakeman et al. | 239/585.5 |

*Primary Examiner*—Karen B. Merritt

*Attorney, Agent, or Firm*—George L. Boller; Russel C. Wells; Jerome R. Drouillard

[57] ABSTRACT

Fuel injector has combination valve-armature fabricated by laser welding relatively more magnetically permeable armature element to relatively less magnetically permeable valve element. Valve element contains sealing ring and landing ring, the latter being circumferentially discontinuous because of fuel passage holes through the valve element, the former being non-symmetrical so that magnetic opening force causes valve-armature to open by tilting about consistent circumferential location on valve element. Initial opening tilting motion is stopped by corrugated stop surface of annular stop member with final tilting motion occurring about the corrugated stop surface until the full perimeter of the valve element abuts the full perimeter of the corrugated stop surface. Actuator has bobbin-mounted coil inserted into frame and encapsulated by outer plastic body. Conical disk spring acting between fuel inlet tube and coil forces one end of the latter against valve body member while forming a barrier between fuel inlet tube and other end of coil so that plastic does not intrude into interior of mechanism during injection molding of outer plastic body. Object of invention is lower fabricating cost for specified performance of injector.

8 Claims, 6 Drawing Sheets

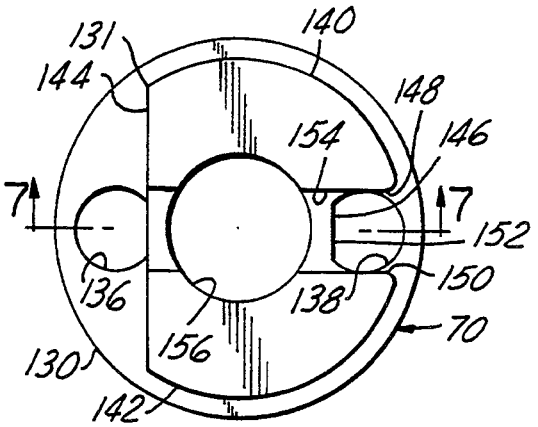
FIG.6
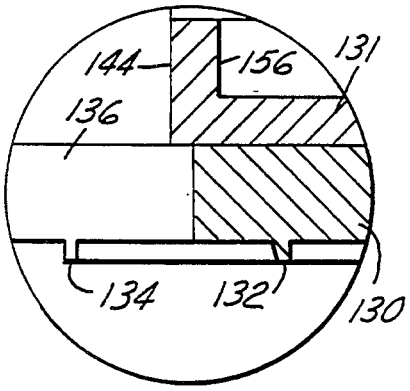
FIG.9
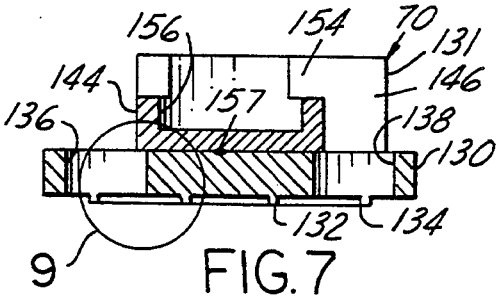
FIG.7
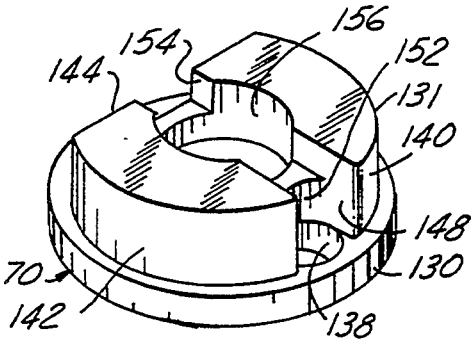
FIG.10
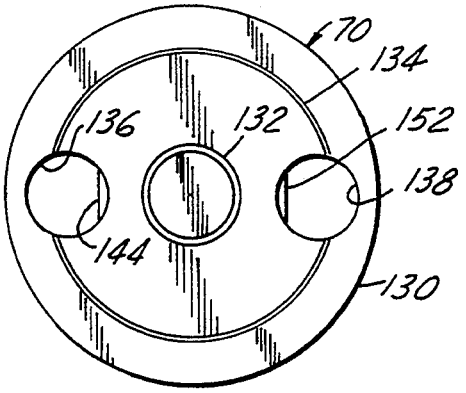
FIG.8
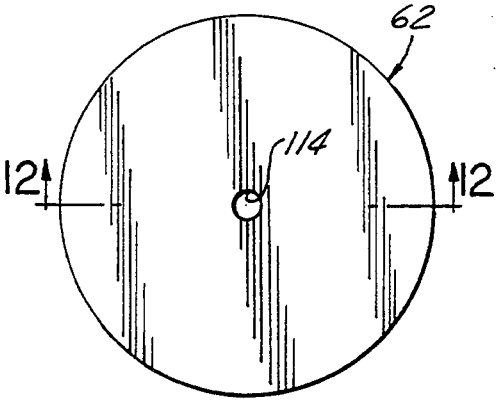
FIG.11
FIG.12
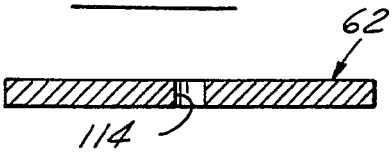

FUEL INJECTOR

This is a divisional of copending application(s) Ser. No. 08/017,719 filed on Feb. 16, 1993, now abandoned.

FIELD OF THE INVENTION

This invention relates to fuel injectors for internal combustion engines.

BACKGROUND OF THE INVENTION

Fuel injectors have enjoyed increasing usage in spark-ignited internal combustion automobile engines over the past several decades and have to a large extent supplanted the carburetor as the means for metering fuel to the engine. In a typical multi-point fuel injection system for a multi-cylinder internal combustion engine, there is one fuel injector per engine cylinder. The fuel injector is poised to inject fuel into the induction air stream for entrainment with combustion air passing to the engine cylinders. Thus, today's typical four-cylinder, six-cylinder, or eight-cylinder engine will be equipped with four, six or eight fuel injectors.

By its nature a fuel injector is a high precision component. The possibility of designing a fuel injector that can be more cost-efficiently manufactured without sacrificing quality and performance merits investigation since, given the size of the global automobile market and the expectation that the usage of fuel injectors will only continue to increase, it is reasonable to anticipate that the market will reward a party who can execute such a design.

The present invention relates to a new and unique fuel injector that is intended to have improved cost effectiveness derived principally from manufacturing considerations. Attention to manufacturing considerations have given rise to a fuel injector in which a number of precision parts are relatively simple in form and only a few parts are more complex. The relatively simple parts, even though they are precision in nature, can be mass produced by established cost-efficient fabrication processes. The relatively more complex parts are obviously more costly to fabricate than the relatively simple ones, but in the aggregate, a more cost-efficient fuel injector results. The parts also provide for the use of more cost-efficient procedures to assemble and adjust the fuel injector. Improvements provided by the fuel injector of the present invention involve features relating both to a number of the individual parts and to cooperative relationships among various parts.

In order to be commercially acceptable, any fuel injector must comply with certain specifications that cannot be compromised. The fuel injector must be capable of accurately and repeatably opening and closing at desired times. When closed, the fuel injector must not leak. The fuel injector must also provide reliable long term performance that remains highly consistent over its useful life.

The present invention is capable of complying with these requirements in a cost effective manner by features relating, inter alia: to a combination valve-armature member that comprises a relatively more magnetically permeable armature element and a harder, relatively less magnetically permeable valve element that are joined together by laser welding; to sealing and landing rings on a flat face of the valve element that is toward a flat face of a circular valve seat member having a central through-hole that is opened and closed by the valve element; to the manner of relating fuel passages through the valve element to these sealing and landing rings; to an annular stop member that comprises a corrugated inner margin for abutment by the valve element to limit displacement of the combination valve-armature member away from the valve seat when the fuel injector in operated open; to the creation of this corrugated margin by an acid etching process; to a skirted orifice disk and the manner of relating it to other internal parts of the fuel injector; to the manner of relating the actuator to the fuel injector; to various internal sealing means; and to methods of assembling various parts of the fuel injector.

The valve seat member is one of the relatively simple parts that can be economically mass produced with precision. It comprises a flat circular disk which has a central through-hole and whose opposite faces are surface finished to a high degree of precision. One of these two surfaces faces the combination valve-armature member, and it is against this surface that the valve element of the combination valve-armature member seats on and unseats from the valve seat member to close and open the central through-hole in the valve seat member. The valve seat member can be very economically fabricated to the requisite precision because of its simple geometry.

Sealing means is provided between the valve element and the valve seat member so that when the fuel injector is closed fuel does not leak from its fuel outlet. This sealing means takes the form of a raised circular sealing ring on the flat surface of the valve element that confronts the flat seating surface of the valve seat member. Since this sealing ring must precisely seal on the flat seating surface of the valve seat member when the fuel injector is closed, the valve element too must be a precision part. In order to maintain precision of the seal over the useful life of the fuel injector, a precision landing ring is also provided in the same surface of the valve element as the sealing ring to engage the valve seat member when the fuel injector is operated closed and thereby react a substantial portion of the closing impact force rather than allowing that force to be reacted solely by the sealing ring. Moreover, the fuel injector must deliver fuel to the area of the valve seat in a way that keeps the sac volume as small as possible, and it must not hydraulically unbalance the combination valve-armature member. (The sac volume is that portion of the internal fuel path which lies downstream of the location where the sealing ring acts.) In order to minimize the sac volume, the diameter and axial dimension of the sealing ring are kept small. In order to maintain satisfactory hydraulic balance on the valve-armature member, fuel passages are provided through it so that when the valve element is closed on the valve seat member pressurized liquid fuel occupies an annular zone intermediate the landing and sealing rings as well as a further annular zone that is radially outwardly of the landing ring. These fuel passageways are diametrically opposite each other, and they intercept the landing ring thereby rendering the latter circumferentially discontinuous while keeping the sealing ring circumferentially continuous. Although certain fabrication costs are concentrated in this combination valve-armature member, overall cost-efficiencies for the fuel injector accrue as a result of efficiencies realized in the fabrication of other parts.

The valve element is circumferentially bounded by a circular spacer ring that is immovably held on the valve body of the fuel injector. This spacer ring can also be cost-efficiently fabricated. The outer circumferential margin of the face of the valve seat member that is toward the valve element serves to hold the spacer ring against a shoulder of the valve body with the stop member being disposed between the spacer ring and the valve body shoulder. The radially inner margin of the stop member radially overlaps the radially outer margin of the face of the valve element that is opposite the face which contains the sealing and landing rings. This radially inner margin of the stop member comprises a corrugated stop face that confronts the valve element. The corrugations are defined by a series of rectangular pockets which are spaced apart side by side in the stop member and that are open both in the axial direction toward the valve element and in the radially inward direction but are otherwise closed by pocket-bounding wall surfaces. This corrugated portion of the stop member is helpful in attenuating the effects of static friction that might otherwise occur if the stop surface were flat and uncorrugated throughout. The stop member corrugations are advantageously formed by an acid etching process. In a modified embodiment, the acid etching process is performed to create a corrugated stop surface comprising a circular annular groove containing small circular buttons uniformly spaced around the groove.

While the valve element is essentially symmetrical about the longitudinal axis of the fuel injector, the armature element is deliberately asymmetrical to provide an unbalanced working gap between the armature element and the stator. As a result, the combination valve-armature member will execute tilting motion away from the valve seat member when the fuel injector is operated open. Furthermore, this tilting motion will occur at the same circumferential location about the combination valve-armature member thereby promoting repeatability of performance which might not be obtainable in a case where an armature is made generally symmetric since such symmetry is apt to result in the tilting motion occurring randomly about the circumference of the combination valve-armature member.

The stop member can be economically fabricated because it is a flat thin ring, and the pockets that form its corrugated surface portion can be created by known acid etching technology. The orifice disk, which is subjacently contiguous the valve seat member, can be economically fabricated by conventional technology. The main valve body and the seat retainer are generally tubular-shaped parts that can be economically fabricated by conventional machining techniques. Because the combination valve-armature member comprises two elements that are other than just simple geometries, more elaborate techniques must be used to fabricate them in any event, and hence the incorporation of a number of structural features into them, such as the landing and sealing rings of the valve element, the fuel passages of the valve-armature member, the shape of the armature element and its joining to the valve element are incorporated to parts which require a number of manufacturing operations anyway; yet an aggregate economy results since the inclusion of such features into parts that already have other than simple geometries yields significant savings in other parts whose geometries can be simplified as a result.

Additional novel features of the invention include: the use of a single O-ring seal to provide three point internal sealing contact with three different parts of the fuel injector; a frustoconical shaped skirt formed in the outer margin of the orifice disk; a conical disk spring washer that resiliently acts between the body of the electric actuator (i.e. the bobbin of the solenoid coil) and a shoulder of the fuel inlet tube that passes through the bobbin to cause the lower flange of the bobbin to forcefully bear against the valve body, while also preventing intrusion of molding material between the fuel inlet tube and the interior of the bobbin when molding material is injected onto assembled component parts of the fuel injector to complete the fabrication by encasing these parts in molded plastic material; and an open sided frame into which the coil assembly is inserted and which, in cooperation with the fuel inlet tube forms a portion of the magnetic circuit for conducting magnetic flux to the armature element of the combination valve-armature member.

A fuel injector fabricated in accordance with principles of the invention is well suited to mass production processes for both metal working and assembly. The fuel injector is also capable of meeting required performance specifications to achieve desired engine operation, keeping in mind fuel economy, exhaust emission requirements and engine performance.

The foregoing, along with additional features, advantages and benefits of the invention, will be seen in the ensuing description and claims which should be considered in conjunction with accompanying drawings. These accompanying drawings disclose a presently preferred embodiment of the invention according to the best mode contemplated at this time for carrying out the invention.

BRIEF DESCRIPTION OF THE DRAWINGS

FIG. 2 is a longitudinal cross-sectional view as taken in the direction of arrows 2—2 in. FIG. 1.

FIG. 6 is a top plan view of one of the members of FIGS. 4 and 5 shown by itself.

FIG. 7 is a cross-sectional view through the member of FIG. 6 in the direction of arrows 7—7 in FIG. 6.

FIG. 8 is a full bottom plan view of the member of FIG. 6.

FIG. 9 is an enlarged fragmentary view taken generally in circle 9 of FIG. 7.

FIG. 10 is a perspective view of the member of FIG. 6.

FIG. 11 is a top plan view of another member of that portion of the fuel injector shown in FIGS. 4 and 5.

FIG. 12 is a cross-sectional view in the direction of arrows 12—12 in FIG. 11.

DESCRIPTION OF THE PREFERRED EMBODIMENT

Figure 1:
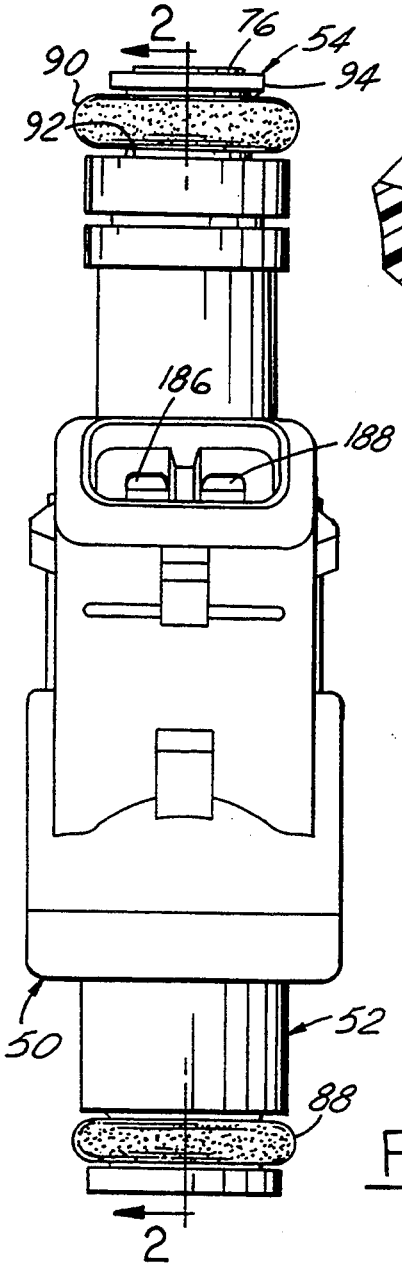
FIG. 1 is a longitudinal view of a fuel injector embodying principles of the present invention.
Figure 2:
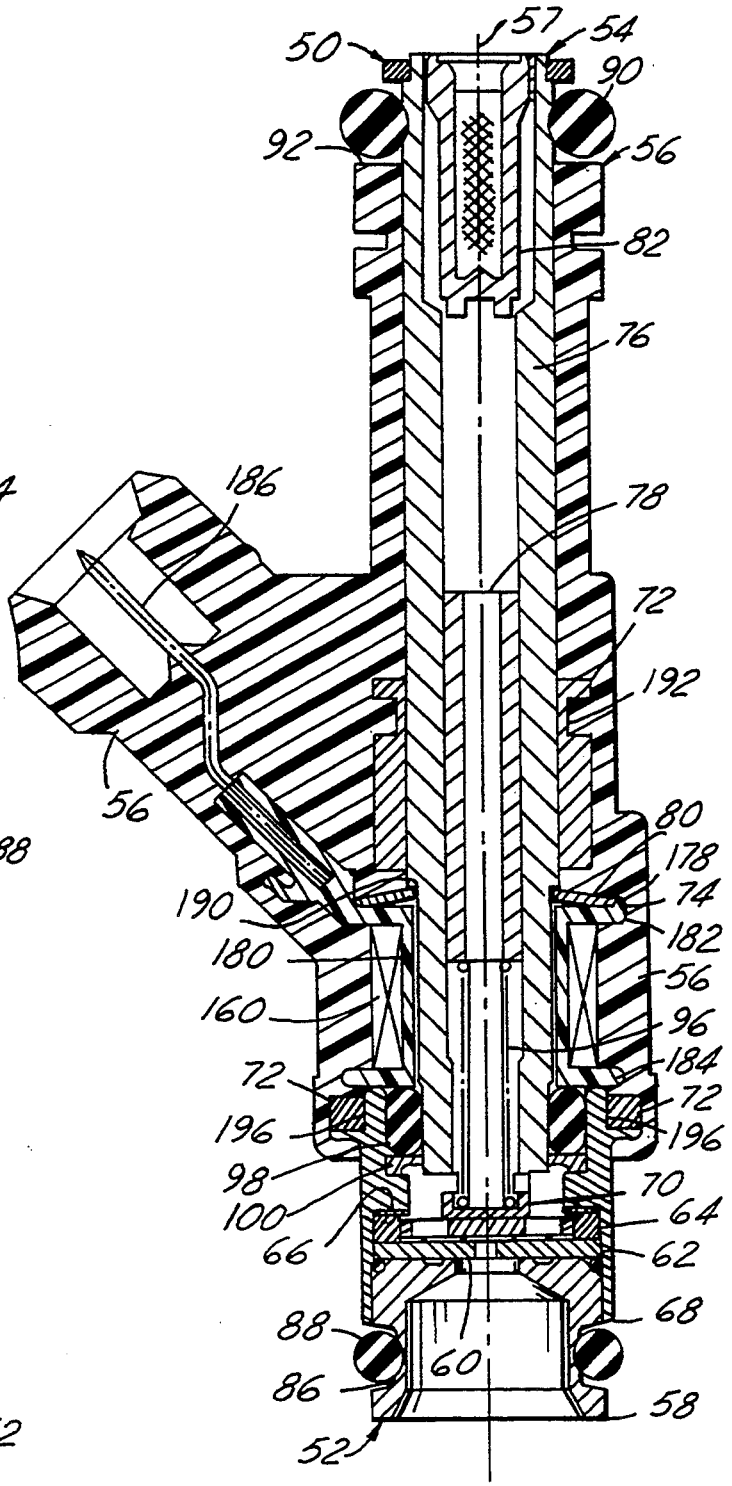
Figure 3:
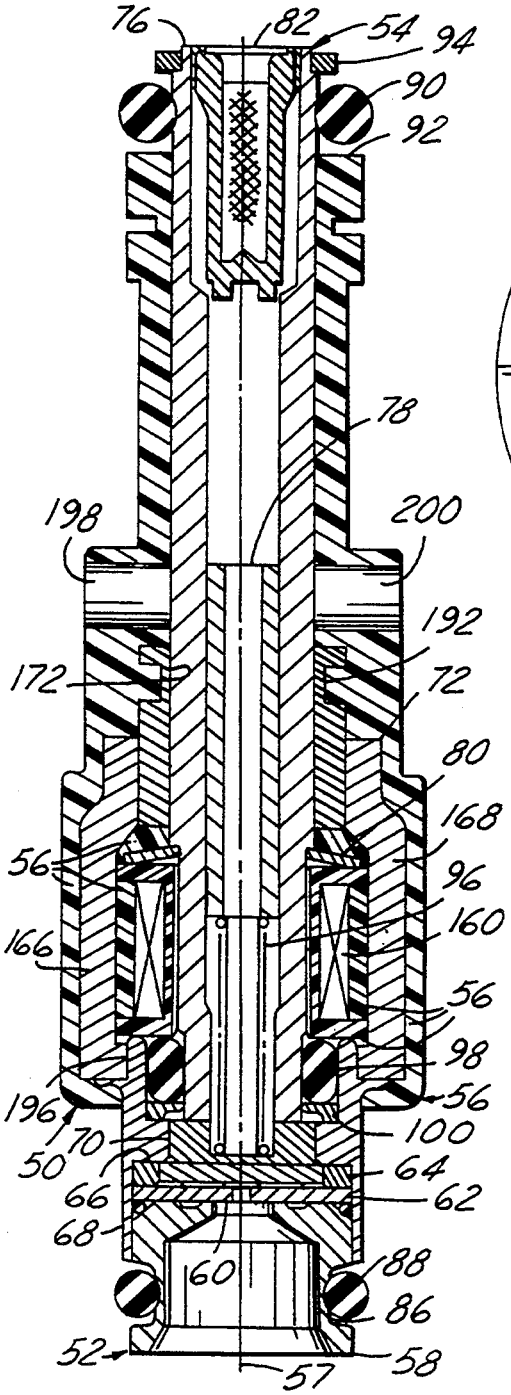
FIG. 3 is a longitudinal cross-sectional view through the fuel injector of FIG. 1 but at right angles to the cross-sectional view of FIG. 2.

FIGS. 1–3 illustrate the general organization and arrangement of an exemplary fuel injector 50 embodying principles of the present invention. In general, it comprises several individual parts that together form a valve portion, or valve group, 52, several individual parts that together form an actuator portion, or power group, 54, and an overmold portion 56 that is molded onto the two groups 52 and 54 to complete the body of the fuel injector. The two groups 52, 54 share a common longitudinal axis 57.

Individual parts forming valve group 52 include: a seat support member 58, an orifice member 60, a valve seat member 62, a spacer member 64, a stop member 66, a main valve body member 68, and a combination valve-armature member 70. Individual parts forming power group 54 include: a frame member 72, a coil and bobbin assembly 74, an inlet tube 76, an adjustment tube 78, a conical disk spring washer 80, and a filter 82.

Immediately proximate the bottom end of the fuel injector, the O.D. of seat support member 58 comprises a groove 86 within which an O-ring seal 88 is disposed for sealing the O.D. of the lower axial end of the fuel injector to the I.D. of a hole in a manifold (not shown) when the fuel injector is installed on an engine. Similarly, immediately proximate the top end of the fuel injector another O-ring seal 90 is disposed around the O.D. of inlet tube 76, and it is axially captured on the inlet tube between an upper terminus 92 of overmold portion 56 and a retaining washer 94 that is secured to the O.D. of the inlet tube. O-ring seal 90 seals the upper axial end of the O.D. of the fuel injector to the I.D. of a hole in a fuel rail (not shown) that serves fuel to the fuel injector. In addition there are a helical compression spring 96, an O-ring seal 98, and an annular shield 100 that are disposed internally of the fuel injector between the two groups 52 and 54.

Figure 5:
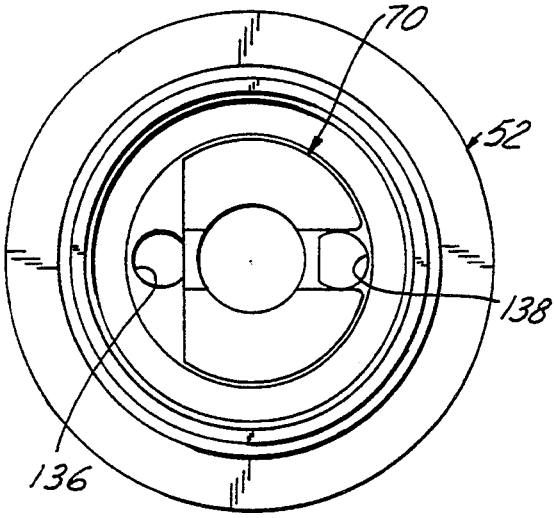
FIG. 5 is a full view in the direction of arrows 5—5 in FIG. 4.
Figure 4:
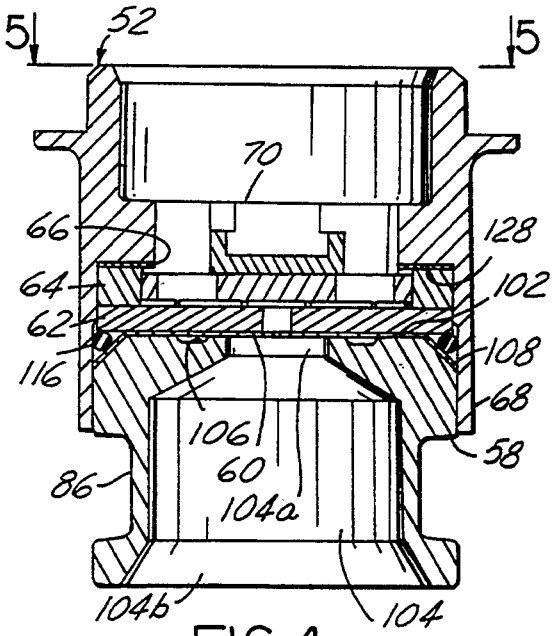
FIG. 4 is an enlarged view of a lower portion of the fuel injector shown by itself and looking in the same direction as the view of FIG. 2.

FIGS. 4 and 5 show valve group 52, less O-ring 88, on an enlarged scale. Seat support member 58 and main valve body member 68 are telescopically fitted together, with a lower portion of the latter axially overlapping an upper portion of the former as shown, to capture and immovably hold orifice member 60, valve seat member 62, spacer member 64, and stop member 66 between themselves. The upper face of seat support member 58 defines a flat planar surface 102 that is at a right angle to axis 57, but is interrupted by a hole 104 centered on axis 57, by a circular groove 106 that is spaced outwardly of and also concentric with hole 104, and by a chamfer 108 at its radially outer margin. Hole 104 extends completely through seat support member 58, comprising a relatively smaller circular entrance 104*a* where the upper surface of seat support member 58 confronts orifice disk 60 and a relatively larger frusto-conically tapered exit 104*b* at the bottom end of the fuel injector.

Figure 13:
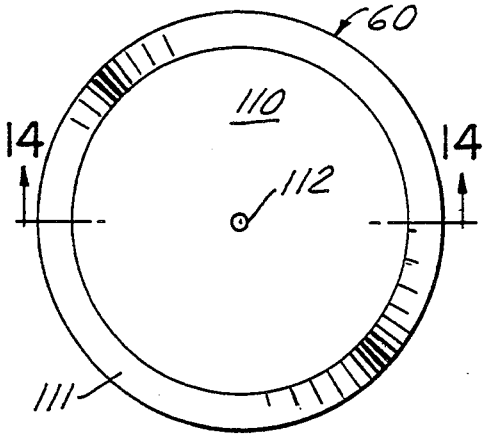
FIG. 13 is a top plan view of still another member of that portion of the fuel injector shown in FIGS. 4 and 5.
Figure 15:
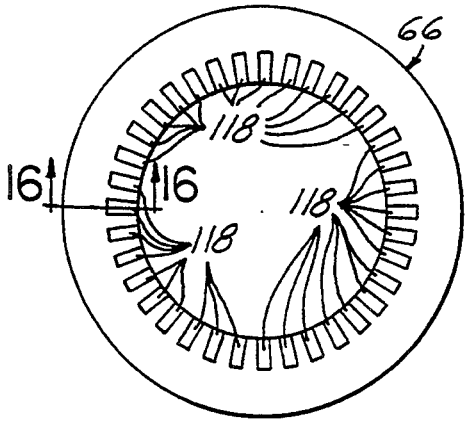
FIG. 15 is a bottom plan view of yet another member of that potion of the fuel injector shown in FIGS. 4 and 5.
Figure 14:
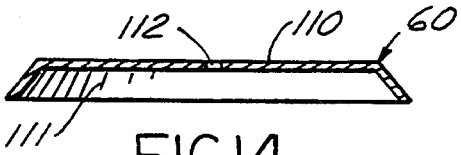
FIG. 14 is a cross-sectional view taken in the direction of arrows 14—14 in FIG. 13.
Figure 16:
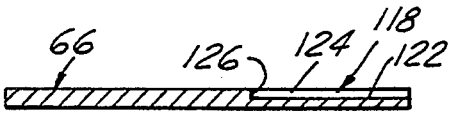
FIG. 16 is an enlarged cross-sectional view taken in the direction of arrows 16—16 in FIG. 15.
Figure 17:
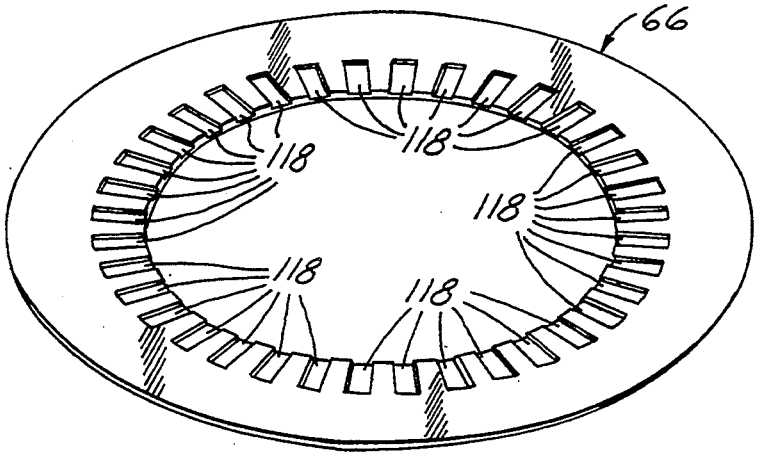
FIG. 17 is an enlarged perspective view of the member of FIG. 15.
Figure 18:
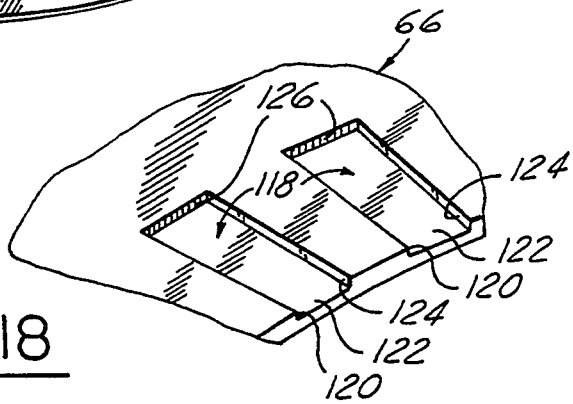
FIG. 18 is an enlarged fragmentary view of a portion of FIG. 17.
Figure 19:
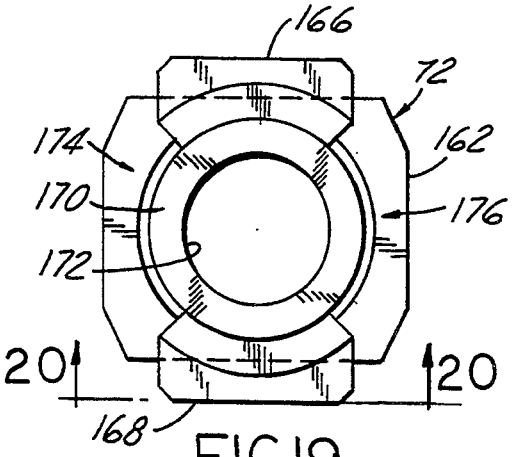
FIG. 19 is a top plan view of a member used in another portion of the fuel injector.
Figure 20:
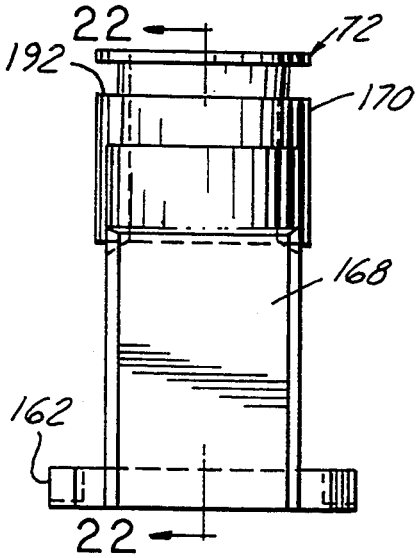
FIG. 20 is a view in the direction of arrows 20—20 in FIG. 19.
Figure 21:
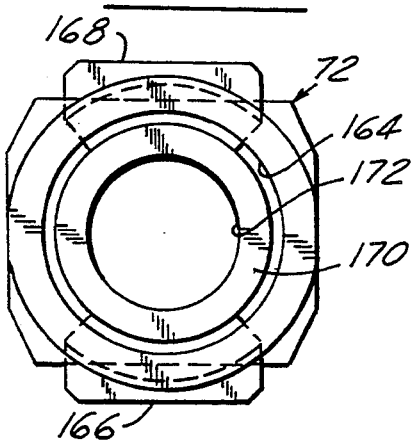
FIG. 21 is a bottom plan view of FIG. 20.
Figure 22:
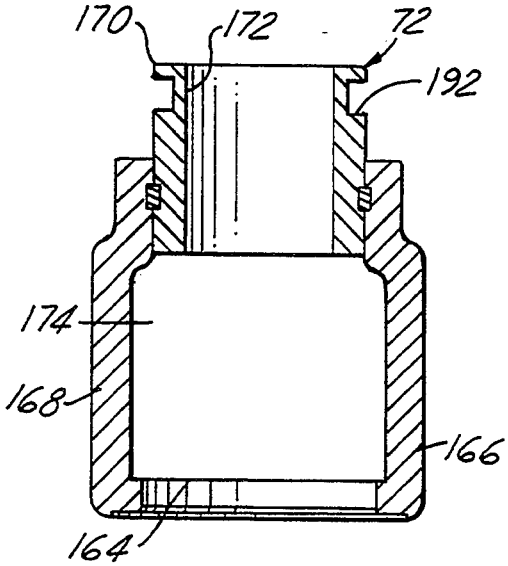
FIG. 22 is a transverse cross-sectional view as taken in the direction of arrows 22—22 in FIG. 20.
Figure 23:
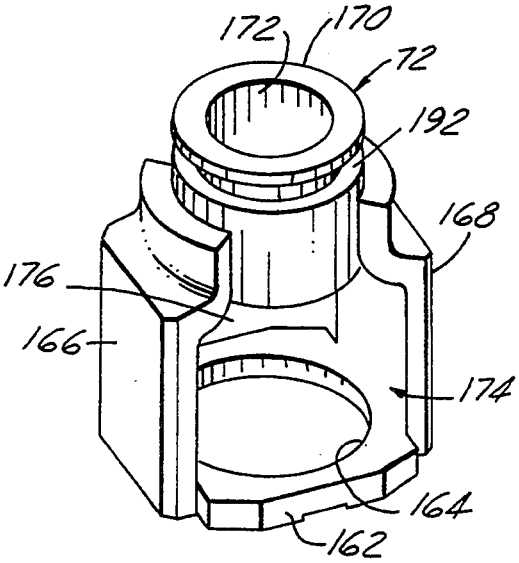
FIG. 23 is a perspective view of the member of FIGS. 19–21.

Orifice member 60 is circular and is fabricated from uniform thickness metal. It is shown by itself in FIGS. 13 and 14. It has a flat central zone 110 that is at a right angle to axis 57. Its outer margin is formed to have a frusto-conical skirt 111. At its center it has a single small circular orifice 112 that is co-axial with axis 57 and registers with entrance 104*a* of hole 104. The lower surface of zone 110 is disposed against surface 102 of seat support member 58, and skirt 111 fits with conformance onto chamfer 108.

Valve seat member 62, which is shown by itself in FIGS. 11 and 12, is circular, having flat, mutually parallel, upper and lower surfaces. Its lower surface is disposed against the upper surface of orifice member 60, and it has a central circular through-hole 114 that is coaxial with axis 57 and thus, registers with orifice 112.

An axially intermediate portion of the inside circular wall surface of main valve body member 68, the outer margin of the lower surface of valve seat member 62, the radially outer margin of chamfer 108, and the surface of skirt 111 that faces away from chamfer 108 define a circular annular internal space, and within this space an O-ring seal 116 is disposed. O-ring seal 116 has three separate endless circular lines of contact, a first with the lower surface of the outer margin of valve seat member 62, a second with the upwardly and outwardly facing surface of skirt 111, and a third with the inside circular wall surface of main valve body member 68. In this way, seal 116 provides sealing that prevents escape of fuel from the interior of the fuel injector through the telescopic joint via which seat support member 58 and main valve body member 68 fit together.

Spacer member 64 is a circular annulus of rectangular cross section. It has a certain axial dimension and a certain radial dimension. Radially outwardly, its O.D. fits closely within the I.D. wall surface of main valve body member 68. Axially and radially inwardly, spacer member 64 is related to combination valve-armature member 70, as will be more fully described later. For now it may be noted that the thickness of spacer member 64 determines the travel of combination valve-armature member 70 between the fuel injector's closed position when member 70 is seated on seat member 62 and the fuel injector's open position when member 70 abuts stop member 66.

Stop member 66 is shown by itself in FIGS. 15–18, and reference to those Figs. will be helpful in understanding how it relates to spacer member 64, main valve body member 68, and combination valve-armature member 70. Stop member 66 is generally a thin annular disk that has circular inside and outside diameters, and that has a uniform thickness throughout, except over a corrugated stop face portion at its radially inner margin. The corrugated stop face portion comprises a series of circumferentially spaced apart pockets 118 in the lower surface of the radially inner margin of the stop member. Each pocket is approximately rectangular in shape, being open axially downwardly and radially inwardly, but otherwise closed. Thus, each pocket may be considered to comprise four wall surface portions 120, 122, 124, and 126. The pockets are identical and equally uniformly spaced about the circumference of the stop member's I.D. Because of features of the fuel injector that will be hereinafter explained in greater detail, stop member 66 can be either a relatively less magnetically permeable material, or a relatively more magnetically permeable material. By employing a hardened material for the stop member, such as a hardened steel, it is better able to perform its stop function for a larger number of valve operations, as will be also explained in more detail later on. The stop member is relatively thin, and the pockets therefor even thinner.

One way of creating the pockets is by acid etching. The stop member starts out as a stamped disk. It is covered with photo-resist material where it is not to be etched, and is left uncovered where it is to be etched. Thus the locations where the pockets are to be created are left uncovered. The disk is placed in acid for an amount of time that etches the pockets to the desired depth in the disk. Thereafter, the disk is removed from the acid, and the photo-resist is removed from the disk. The hole in the center of the stop member may be created in an analogous manner before the pockets are etched.

The corrugated inner margin of stop member 66 formed by pockets 118 provides a hardened stop surface that is disposed in the path of travel of combination valve-armature member 70 for abutment therewith. One purpose of providing the pockets is to reduce the surface-to-surface area of contact between the stop member and the combination valve-armature member when the latter is in abutment with the former. In this way, static friction will be less of an impediment to separation of the two when the fuel injector is operated closed than would be the case if the stop member lacked the pockets. Advantageously, the pockets do not impair the integrity of the stop member because each one is closed on four sides and open on only two.

Returning now to FIG. 4, it can be explained that a radially outer portion of stop member 66, which is of uniform thickness throughout, is held between the upper surface of spacer member 64 and a radial shoulder 128 on the inside wall surface of main valve body member 68. Radially, stop member 66 has a close fit to the axially extending inside wall surface of main valve body member 68, and hence it is coaxial with axis 57. Shoulder 128 protrudes radially inwardly somewhat beyond the I.D. of spacer member 64 so that the entirety of a radially inner marginal portion of the upper surface of stop member 66 is disposed flat against shoulder 128. On the opposite face, the corrugated zone defined by pockets 118 is disposed radially inwardly of the I.D. of spacer member 64.

Attention is now directed to FIGS. 6–10 for a detailed description of combination valve-armature member 70. This member comprises two parts, a valve element 130 and an armature element 131, that are joined together. Valve element 130 is a circular plate whose upper surface is flat, and whose lower surface is also flat but for the presence of a radially inner sealing ring 132 and a radially outer landing ring 134. Each of the two rings is a raised ridge that is of uniform axial dimension throughout, and the axial dimensions of the two rings are identical. In radial cross section, landing ring 134 has a rectangular shape while sealing ring 132 has a trapezoidal shape, as best seen in FIG. 9. Sealing ring 132 is circumferentially continuous while landing ring's 134 circumferential continuity is interrupted by the fact that valve element 130 has two circular through-holes 136, 138 that are eccentric to axis 57 such that they intercept the landing ring on diametrically opposite sides thereby making the landing ring circumferentially discontinuous. FIG. 4 shows the closed condition wherein valve element 130 is closed on valve seat member 62. In this closed condition, sealing ring 132 has circumferentially continuous sealing contact with valve seat member 62 in surrounding relation to through-hole 114.

Valve element 130 can be fabricated by conventional metalworking procedures. While it can be machined entirely from bar stock, it can also be made by first creating a disk by fine-blanking. Holes 136 and 138 can be created by blanking or machining. The landing and sealing rings are created by turning the disk on a lathe. Smooth and flat surface finishes and dimensional accuracy are obtained by free abrasive machining (i.e., flat disk lapping).

Armature element 131 is a somewhat circular part that is truncated along the chord of a circle. Thus, as viewed in FIG. 6, the perimeter of the armature element comprises two circularly contoured segments 140, 142 that lie on an imaginary circle that is concentric with axis 57, and a chordally truncated segment 144 joining one pair of adjacent ends of segments 140, 142. The other pair of adjacent ends of segments 140, 142 are spaced apart by an axially extending through-notch 146 in the armature element. This through-notch is somewhat U-shaped having three sides 148, 150, 152. The axial dimension of side 148 equals that of side 150, but the axial dimension of side 152 is less than that of sides 148 and 150; this is because the armature element has a diametrically extending slot 154 in its upper half that lies perpendicular to segment 144 as viewed in FIG. 6. At its center, the armature element has a circular blind hole 156 extending from its upper surface approximately three-fourths of the axial dimension of the armature element.

Armature element 131 is joined to valve element 130 such that hole 156 is coaxial to the circular valve element. The armature element is circumferentially oriented to the valve element in the assembly such that through-notch 146 is registered with hole 138, and this also leaves most of hole 136 uncovered by the armature element. Joining of elements 130 and 131 to each other is conducted by laser welding in the center to create a weld 157.

The resulting shape of combination valve-armature member 70 is such that it is not symmetrical about the valve group's axis 57. As will be explained in more detail later on, this results in the combination valve-armature member executing a tilting motion when operated.

A detailed description will now be given of the members of power group 54, and attention is first directed to details of frame member 72 which can be seen in FIGS. 19–23. The purposes of frame member 72 include: providing a magnetic flux path for coupling magnetic flux issued by the coil 160 of coil and bobbin assembly 74 to valve group 52 for operating combination valve-armature member 70; and providing a means by which inlet tube 76 can co-axially locate frame member 72 and coil and bobbin assembly 74. Frame member 72 comprises a bottom 162 which has a central circular hole 164. It also has sides 166, 168 which extend axially from opposite side edges of bottom 162 to embrace and join with a tubular-shaped top 170. Top 170 comprises a circular through-hole 172 that is coaxial with axis 57 in the completed fuel injector. Sides 166, 168 confront each other across the frame member, leaving confronting side openings 174, 176 that face each other and that are disposed at ninety degrees to sides 166, 168.

In addition to coil 160, coil and bobbin assembly 74 comprises a bobbin 178 that has a tubular core 180 with circular flanges 182, 184 at opposite ends. Terminations of the wire forming coil 160 are joined to interior ends of respective electrical terminals 186, 188 which are embedded in a projection of bobbin 178 that extends at an angle from a location on the perimeter of flange 182. The exterior ends of terminals 186, 188 are free to provide for mating with respective terminals of a plug (not shown) via which energizing current is selectively delivered to coil 160 for selectively operating the fuel injector. Coil and bobbin assembly 74 is associated with frame member 72 by insertion through one of the side openings 174, 176 to align tubular core 180 with through-hole 172 prior to insertion of inlet tube 76 into through-hole 172 and through tubular core 180.

Figure 24:
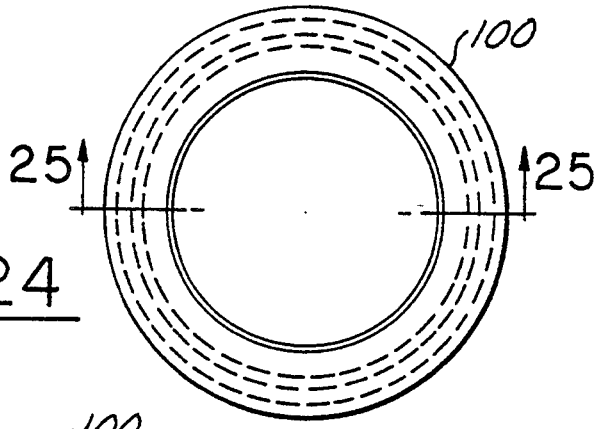
FIG. 24 is an enlarged top plan view of yet another member used in the fuel injector.
Figure 25:
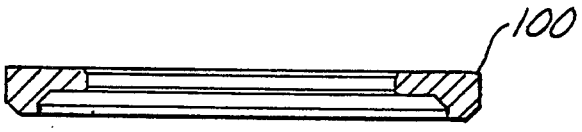
FIG. 25 is a cross-sectional view in the direction of arrows 25—25 in FIG. 24.

A description of how the fuel injector is assembled will now be given. The upper end of main valve body member 68 is shaped for telescopic engagement with hole 164 and abutment with frame member 72 to axially and radially locate frame member 72 and valve body member 68 relative to each other. After relating the frame member and the main valve body member in this manner, they are united, such as by laser welding. Seal 98 and shield 100 are placed within member 68, coil and bobbin assembly 74 is disposed within the frame member, and inlet tube 76 is passed through hole 172, tubular core 180 of bobbin 178, seal and shield 100. The purpose of shield 100, which is shown in detail in FIGS. 24 and 25, is to assure axial location of seal 98 away from valve-armature member 70. Note also that the lower inner margin of shield 100 is relieved so that the shield does not come in contact with valve-armature member 70.

The inlet tube 76 is properly axially located by a fixture (not shown), whereupon it is united with frame member 72. Uniting of the inlet tube and frame member is accomplished by providing a circular groove 192 in top 170 to locally reduce the wall thickness of the tube, as shown, and then laser welding the two parts together at the tube's reduced thickness. Note that during the locating of the inlet tube, conical disk spring washer 80 is being resiliently stressed between a shoulder 190 extending around the outside of the fuel inlet tube and flange 182 of bobbin of bobbin 178. The fixture for locating the inlet tube locates the lower end of the tube relative to shoulder 128. These assembled parts are placed in a mold (not shown), and overmold portion 56 is formed on them to create the body shape shown. The overmold portion also encloses all but the exterior ends of terminals 186 and 188 and forms a surround about those exterior ends for reception of a connector plug (not shown) containing terminals that mate with terminals 186 and 188. Conical disk spring washer 80 forms a barrier between the upper end of bobbin 178 and inlet tube 76, and it creates a barrier at the lower end of the bobbin by forcing the latter against the upper edge of main valve body member 68. These barriers prevent intrusion of plastic into the interior valve mechanism.

Next, the remaining parts of the valve group are assembled into the open lower end of main valve body member 68 with spring 96 disposed between armature element 131 and adjustment tube 78. Seat support member 58 sandwiches parts 62, 64, and 66 against shoulder 128, and then it and main valve body member 68 are joined, such as by laser welding at the location designated 196.

Overmold portion 56 contains two radial holes 198, 200 in an area where tubes 76 and 78 overlap. The fuel injector is calibrated by properly positioning adjustment tube 78 within inlet tube 76 and then uniting the two tubes, such as by crimping, via access that is provided by holes 198, 200.

When the fuel injector is in use, liquid fuel, such as gasoline, is introduced through inlet tube 76, being filtered by filter 82 in the process, and then passing completely through tube 76 to the internal space where valve-armature member 70 is located. Fuel can readily pass through valve-armature member 70 to both the annular space between the sealing and landing rings and the annular space that is radially outwardly of the landing ring.

When coil 160 is not energized, valve element 131 is seated on valve seat member 62 such that sealing ring 132 fluid-isolates hole 144 from holes 136 and 138. Ring 132 and the upper surface of valve seat member 62 have sufficiently fine surface finish and mating surface area that they provide a metal-to-metal seal in this condition, and hence no fuel can flow out of the fuel injector.

When coil 160 is energized, the valve opens. The energizing of coil 160 creates a magnetic flux that gives rise to a magnetic force acting between the lower axial end of inlet tube 76 and armature element 131. Because of the shape of the armature element as hereinbefore described, the force acts on the valve-armature element eccentric to axis 57. While the O.D. of valve element 130 has a close fit to the I.D. of spacer member 64, that fit is not sufficiently tight to absolutely constrain the valve-armature member to strict axial displacement toward inlet tube 76, but rather allows the eccentrically applied attraction force to tilt the valve-armature member until the tilting portion hits stop member 66. Thus as the valve-armature member begins to tilt in response to energizing of coil 160, the axis of the valve-armature member becomes increasingly tilted relative to axis 57 until the tilting portion abuts stop member 66. At that point, the motion of the valve-armature member continues, but now with the valve-armature member tilting about the location where it abutted stop member 66. As this tilting motion continues, the tilt of the axis of the valve-armature member decreases, and coincidence with axis 57 is re-attained when the tilting motion is arrested by abutment of the entire margin of valve element 130 with stop member 66. Thus this margin valve element 130 represents an abutment face portion of valve-armature member 70. It should be observed that when the opening motion of valve-armature member 68 has been arrested, the armature element is still spaced from the end of inlet tube 76. With the valve element unseated from the valve seat member, fuel can flow through holes 114, 112, and 104 to be injected from the bottom end of the fuel injector.

When the energizing of coil 160 ceases, the magnetic attraction force ceases. Spring 96 pushes the valve-armature member closed against valve seat member 62, thereby terminating flow through the fuel injector so that fuel ceases to be injected from the lower end of the fuel injector. As should be appreciated, the amount of axial travel that is executed by the valve-armature member between closed and full open position is equal to the thickness of valve element 130 subtracted from the thickness of spacer member 64.

The organization and arrangement of the valve group provides important advantages. Because the combination valve-armature member comprises respective armature and valve elements, the valve element can be made from material that is best suited for assuring proper sealing contact with the valve seat member over the life of the fuel injector while the armature element can be made from material that has suitable ferromagnetic properties. Reliable joining of the two elements is assured by the use of laser welding in the manner indicated. The lower end of inlet tube 76 forms a stator for the magnetic flux issued by coil 160. Flux passes across the working gap to act on armature element 131. Return flux passes from the lateral sides of armature element 131 to main valve body member 68 and thence via frame member 72 back to tube 76 at the upper end of coil and bobbin assembly 74. Consequently, stop member 66 forms substantially no part of the magnetic flux path so that it can be made from a hard material that is well-suited for use with the hardened valve element 130. During assembly of the fuel injector, circumferential orientation of the valve group parts is unnecessary, yet the unbalanced design of the combination valve-armature member will assure that it always tilts about the same location on the valve elements perimeter, regardless of its particular circumferential orientation within the fuel injector, and this will be beneficial toward securing consistency in the valve's operation.

Figure 26:
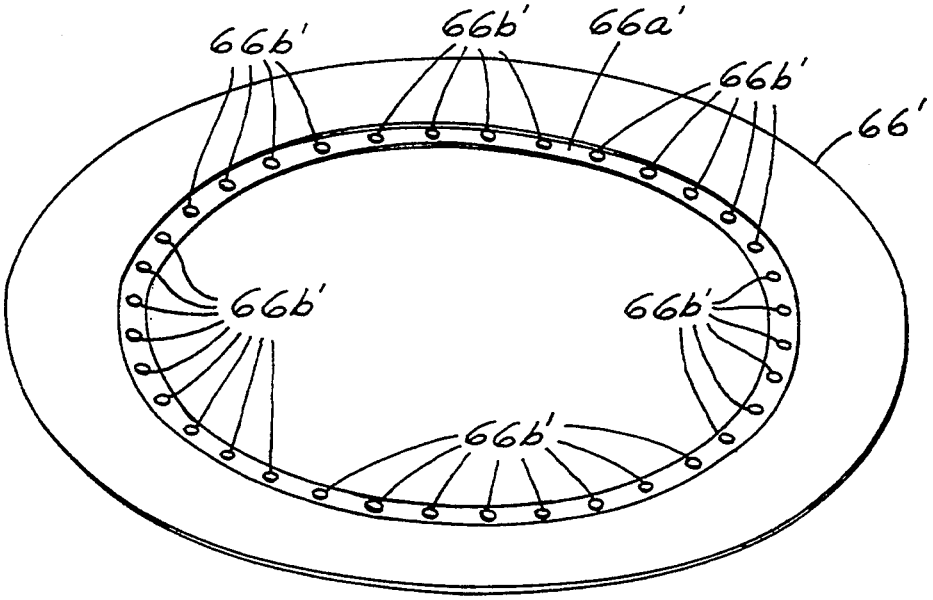
FIG. 26 is a view similar to FIG. 17, but presenting a modified embodiment.
Figure 27:
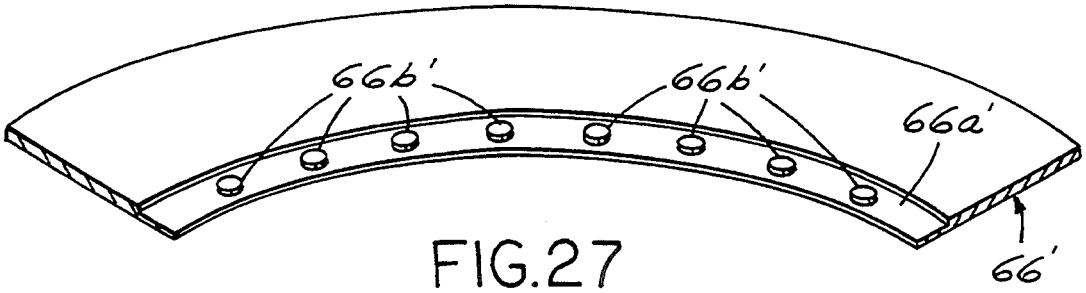
FIG. 27 is an enlarged fragmentary view of FIG. 26.

FIGS. 26 and 27 disclose another embodiment of stop member, designated 66'. Like stop member 66, it comprises a corrugated stop face portion, but of a somewhat different shape from that of stop member 66. Stop member 66' is a circular annular member that is of uniform thickness radially outwardly of its radially inner corrugated margin that forms the stop face portion. The radially inner corrugated margin may be considered to comprise a circular annular groove **66*a'* containing a series of identical circular buttons 66*b*° at regular spacing intervals. Thus, the corrugations of stop member 66' may be considered, like stop member 66, to comprise a series of side-by-side pockets, with buttons 66*b'* between the pockets. Groove 66*a'*** is created by acid etching techniques, and the height of the buttons is equal to the depth of the groove so that the end faces of the buttons are in the same plane as the corresponding axial end face of the uncorrugated portion of the stop member.

The foregoing description has disclosed details of a presently preferred embodiment of a new and improved fuel injector for internal combustion engines, and what is claimed for the invention is as follows:

What is claimed is:

1. A fuel injector having a fuel inlet for fluid communication to a supply of pressurized liquid fuel and a fuel outlet from which fuel is injected out of the fuel injector and comprising a solenoid actuator portion and a valve portion sharing a longitudinal axis, said solenoid actuator portion comprising a solenoid actuator, said valve portion comprising a valve body within which is contained means that is selectively operable by said solenoid actuator to open and closed positions to open and close the fuel injector to fuel flow between said fuel inlet and said fuel outlet, said solenoid actuator comprising a coil that is co-axially disposed on a non-metallic bobbin, and stator means comprising a magnetically permeable tube that passes axially through said bobbin and said coil and via which magnetic force is delivered to said valve portion for operating said means to open and close the fuel injector to flow, and a conical disk spring washer that encircles said tube, that has an inside diameter resiliently bearing against a shoulder on an outside diameter of said tube, and that has an outside diameter resiliently bearing against said bobbin to resiliently urge the latter axially against said valve body.

2. A fuel injector as set forth in claim 1 in which said conical disk spring washer is imperforate and resiliently bears against said shoulder and said bobbin with full circumferential sealing contact between itself and said tube and with full circumferential sealing contact between itself and said bobbin, and in which said bobbin is forced by said conical disk spring washer to resiliently bear against said valve body with full circumferential sealing contact between itself and said valve body, and including an overmold enclosing said coil, said bobbin, said conical disk spring member, and portions of said valve body and said tube that are immediately contiguous the respective circumferential sealing contacts between said conical disk spring member and said tube on the one hand and between said bobbin and said valve body on the other hand, but said overmold does not intrude through the three aforementioned full circumferential sealing contacts.

3. A method of making an electromagnetic fuel injector having an actuator portion and a valve portion including the steps of disposing a bobbin-mounted electromagnetic coil within a frame member by passing said bobbin-mounted electromagnetic coil through an opening in a lateral side of said frame member, aligning a central through-hole in said bobbin-mounted electromagnetic coil with axially aligned through-holes in said frame member, and passing a tube through said aligned through-holes in said bobbin-mounted electromagnetic coil and said frame member.

4. A method as set forth in claim 3 including the further step of joining said tube to said frame member.

5. A method as set forth in claim 3 including the further step of resiliently deforming a conical disk spring washer between a shoulder of said tube and a flange of said bobbin so as to cause the conical disk spring washer to forcefully bear against both shoulder and flange as the tube is being passed through said aligned through-holes in said bobbin-mounted electromagnetic coil and said frame member.

6. A method as set forth in claim 5 including the further steps of joining said frame member to a valve body member of said valve portion, joining said tube to said frame member after the tube has been disposed in a desired relation to said valve body member, and overmolding a body portion of the fuel injector onto said tube, said frame member, and said valve body member.

7. A method as set forth in claim 6 including the further step of using said conical disk spring washer to force said bobbin against said valve body member while said overmolding step is being conducted.

8. A method as set forth in claim 7 including the further step of assembling internal valve mechanism into said valve body member after the completion of said overmolding step.

* * * * *